United States Patent [19]

von Seidlitz

[11] 4,278,007

[45] Jul. 14, 1981

[54] HAND LEVER FOR OPERATING THE WEDGE-TYPE BREECHBLOCK OF AN ARTILLERY GUN

[75] Inventor: Henning von Seidlitz, Neuss, Fed. Rep. of Germany

[73] Assignee: Rheinmetall GmbH, Duesseldorf, Fed. Rep. of Germany

[21] Appl. No.: 48,016

[22] Filed: Jun. 13, 1979

[30] Foreign Application Priority Data

Jun. 19, 1978 [DE] Fed. Rep. of Germany ..... 2826739

[51] Int. Cl.[3] ..... F41F 11/00

[52] U.S. Cl. ..... 89/24

[58] Field of Search ..... 89/24

[56] References Cited

U.S. PATENT DOCUMENTS 2,434,972 1/1948 Vick ..... 89/24

*Primary Examiner*—Stephen C. Bentley

[57] ABSTRACT

A hand lever for operating the wedge-type breechblock of an artillery gun is disclosed. A breech operating shaft is placed near the breech ring of the gun and connected to the breechblock and is actuated through a drive by the hand lever. The drive couples shaft and hand lever upon actuation of the lever and otherwise automatically releases the coupling between shaft and hand lever resulting in dropping of the hand lever upon discontinuance of the actuation.

6 Claims, 7 Drawing Figures

HAND LEVER FOR OPERATING THE WEDGE-TYPE BREECHBLOCK OF AN ARTILLERY GUN

BACKGROUND OF THE INVENTION

1. Field of the Invention

The present invention relates to a hand lever coupled to a shaft for operating the wedge-type breechblock of an artillery gun.

2. Description of the Prior Art

A charging hand lever is disclosed by D'Andrea in U.S. Pat. No. 3,362,292. This lever is solidly attached to a crank and located at the side of the bottom of the gun. When the breechblock is in a closing position closed and locked, then the charging hand lever is in a vertical location and is located near the plane to the rearward front of the breech ring. The breechblock is opened by turning the lever by 90° downward. The lever is now in a horizontal position and protrudes far into the rear behind the bottom part. Even though the charging hand lever does itself not participate in the recoil motion of the weapon, it nevertheless represents a grave danger for the gun operator based on its horizontal position protruding into the operating area of the gun, while the breechblock is in open position.

1. Purpose of the Invention

It is an object of the invention to improve the structure of a hand lever for operating the wedge-type breechblock of an artillery gun in order to avoid the disadvantages set forth above and for effecting a rapid and safe breechblock motion.

It is another object of the invention to provide for an automatic release of the lever coupling with the shaft without the assistance of a person upon non-actuation for eliminating a possible safety risk to the gun-operating person.

These and other objects and advantages of the present invention will become evident from the description which follows.

2. Brief Description of the Invention

According to the present invention a hand lever system initiating the motion of the wedge-type breechblock of an artillery gun is provided. A shaft located at the bottom of the gun is connected with the breechblock. A drive connects the shaft with the hand lever and provides a coupling between shaft and lever upon actuation of the lever and otherwise automatically releases the coupling between shaft and lever resulting in dropping of the lever upon discontinuance of the actuation.

The hand lever comprises a loose socket wrench capable of being coupled to the shaft. The cooperating parts of lever and shaft are formed such as to provide upon operation of the lever a coupling with the shaft in both directions of rotation. Upon non-actuation of the lever the coupling automatically disengages and the charging hand lever falls down.

In one aspect of the invention, the shaft is provided with a locking head ending at about the lever of the breech ring. The head is parted by a two-step slot with prismatic surfaces coverging toward the side of the shaft and open at the ends. The head is capable of receiving a two-step bolt located at the free end of the hand lever. The cooperation of one pair of the head and the bolts results in a coupling between head and bolt and the other pair of steps is provided with measures for releasing the coupling.

In another aspect of the invention, the inner step of the head is formed as a roof shaped wedged groove with a stop dog increasing from the middle to both outward sides in height. A corresponding engaging dog of the outer step of the bolt engages behind the stop dog upon actuation of the hand lever to provide a coupling with the shaft. Furthermore, the engaging dog of the outer step of the bolt is formed by inclined planes of the inner step which meet at the middle of both sides in the shape of a roof. Each of the two inclined planes has protruding the head of a pretensioned spring bolt, which exert a pressure against the planar surface of the outer step of the locking head for placing the bolt in a middle position relative to the head.

In one feature of the invention the charging hand lever system comprises a drive coupling between the lever and the end of the shaft. The drive comprises a socket having a two-step bolting slot and each step has prismatic surfaces converging toward the side of the crank. Said slot is open toward the outside at both ends of the slot. A head at the free end of the lever has a two-step bolt with one step of the bolt and the locking slot providing a coupling between the hand lever and the shaft. The other step of the bolt and locking slot have means for releasing the coupling. The hand lever system can have about the same level as the breech ring of the gun.

The inner step of the locking slot is a roof shaped wedge groove with a stop dog which increase in height from the middle towards the two outsides for engaging the corresponding engaging dog of the outer step of the bolt. The engaging dog of the outer step of the bolt is formed by roof shaped inclined planes which converge in the middle. The head of the pretensioned spring bolt protrudes from each of the two inclined planes. The spring bolt heads exert pressure upon the inclined planes of the socket for placing the bolt in a middle position with regard to the slot of the socket. The width of the bolt is in general smaller than the clear width of the slot of the socket at the point of the locking position.

Furthermore, the hand lever is by its length, its weight, and its center of gravity as well as the distance and the pretension of the spring bolts and by the shape of the bolt and of the relative locking head slot adapted for automatically separating through the middle position from the coupling with the shaft.

Thus, the new hand lever system is not only simple to operate, but simultaneously it is to a large extent safe from accidents, since even when the gun operator does not remove the hand lever after use, it separates automatically and falls to the floor.

The invention accordingly consists in the features of construction, combination of elements, arrangements of parts, which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention.

DETAILED DESCRIPTION OF THE PREFERRED EMBODIMENTS

Figure 1:
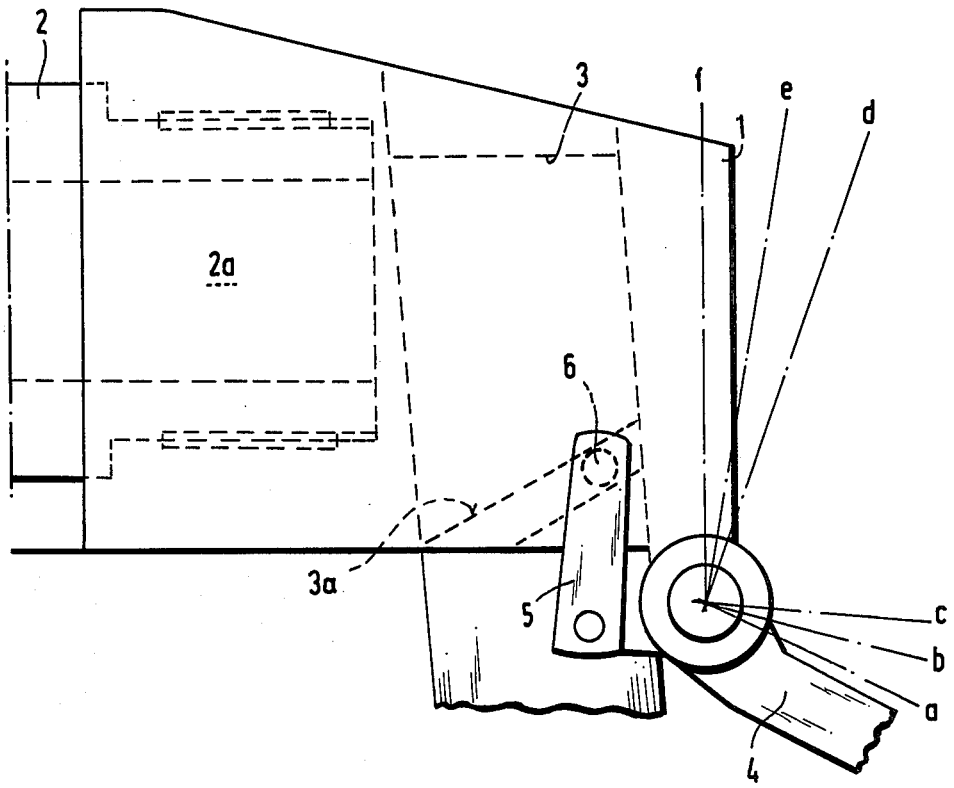
FIG. 1 is a view of a schematic diagram of the breech ring and the barrel of and artillery gun having a wedge-type breechblock and a hand lever for operating said breechblock.
Figure 2:
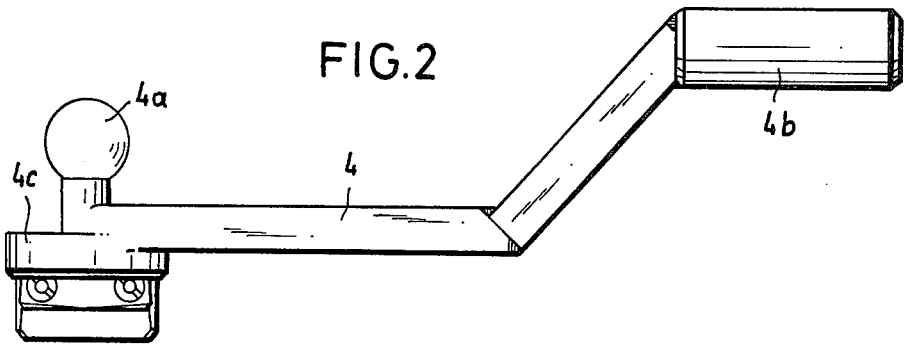
FIG. 2 is a top view of the hand lever.
Figure 3:
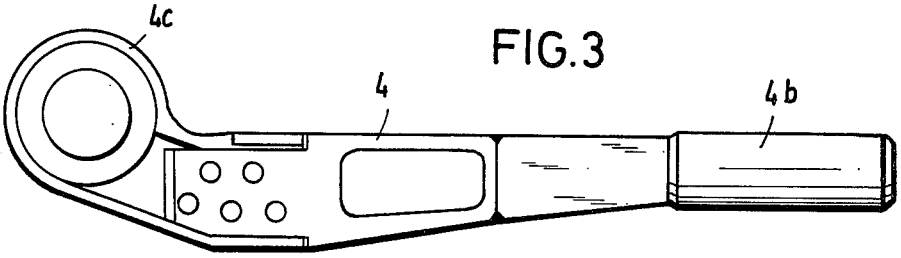
FIG. 3 is an elevational view of the hand lever.
Figure 4:
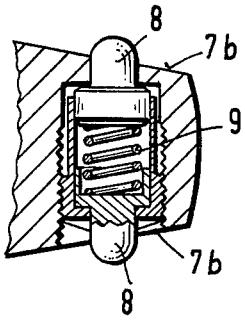
FIG. 4 is a sectional view of spring bolts mounted in the hand lever.
Figure 5:
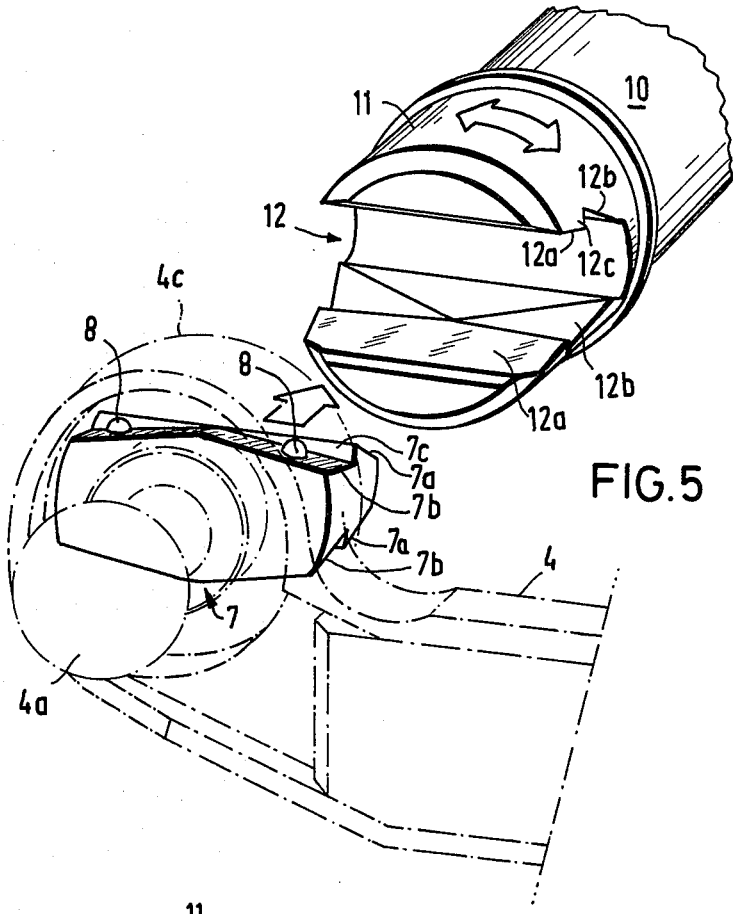
FIG. 5 is a perspective view of the bolt attached to the charging hand lever before introduction into the locking slot of the shaft end.

Referring now to FIG. 1 there is shown the breech ring 1 of an artillery gun with firmly screwed in barrel 2. A wedge-type breechblock 3 is movable in the vertical direction from the end of the chamber 2*a* and the barrel 2. An interior recessed inclined slot 3*a* is machined into the breechblock 3. The breechblock 3 can be opened by means of a lever system 5 connected to the hand lever 4 via the pin 6, which is rotatably mounted on the lever system 5 and which engages the inclined slot 3*a*.

The hand lever 4 has a certain length and is provided at its front end with a hand knob 4*a* and at its rear end with a handle 4*b*. Opposite to the hand knob 4*a* is placed a bolt 7 at the bearing 4*c* of the hand lever 4. The two front areas on the sides of the bolt have a cylindrical shape. The bolt 7 is derived from a cylindrical disc which by way of an upper and lower, parallel running circle segment results in a body of substantially rectangular shape.

The intersecting planes generated by the two circular segments are submitted to special treatment. Each of the two sectional planes comprises an outer and an inner step 7*a* and 7*b*, respectively. The outer step 7*a* is an inclined plane, but the inner step 7*b* is formed by two inclined planes coming together in the middle and shaped like a roof on both sides. Through the latter a sharp engaging step 7*c* is formed as delineation between the step pair 7*a* and 7*b* and the engaging step 7*c* increases in size going from the middle to the outsides. Since the bolt 7 is of a symmetrical shape there are present two outer steps 7*a* and two inner steps 7*b* and the steps 7*a* comprise one inclined planar surface and the step 7*b* comprise roof shaped, buckled inclined planes.

A spring bolt 8 is inserted in each of the buckled inclined planes, thus there are four spring bolts 8 present in the two inner steps 7*b* of the bolt 7. The spring bolts 8 are held in pairs with a joint pressure spring 9 under a certain pretension and they protrude when in free position so far from the inclined planes that they end about at the level of the engaging dog 7*c*.

Figure 6:
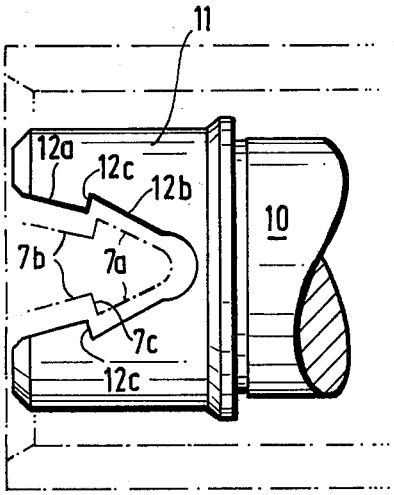
FIG. 6 is an elevational view of the locking slot of the shaft with engaged bolt.

The counterpart of the bolt 7 is a locking slot 12 which is machined from a locking head 12 located at the free end of crank 10. As shown in FIG. 6 the locking head 11 ends about at the level of the rear end of the breech ring 1. The locking slot 12 with a depth corresponding to the depth of the bolt 7 also has outer step 12*a* and an inner step 12*b*, which are successively machined in the prismatic recess of the locking slot 12.

The steps 7*a* and 7*b* of the bolt 7 match the steps 12*a* and 12*b* of the locking slot 12 such that the outer step 7*a* of the bolt 7 which runs in one inclined plane engages the inner step 12*a* of the locking slot 12 which comprises a roof shaped wedge groove with a stop dog 12*c* increasing in height from the middle to both sides.

On the other hand the inner step 7*b* of the bolt 7, which is formed like a roof and provided with a spring bolt 8 on each plane, corresponds to the outer step 12*a* of the locking slot 12, which in turn is one inclined plane.

The cooperation of the step pair 7*a* and 12*b* or 7*b* and 12*a* insures that in each case a planar and a roof shaped step are placed opposite to each other.

Figure 7:
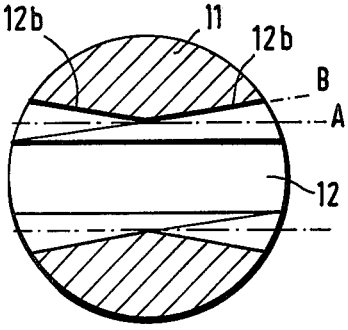
FIG. 7 is a sectional view of the locking slot of the shaft with engaged and coupling bolt.

The hand lever operates as follows:

In normal position with closed breech-block 3 hand lever 4 with the bolt 7 in position b is introduced with the locking slot 12 of the locking head 11 of the shaft 10 by holding the lever with both hands at the hand knob 4*a* and at the handle 4*b*. Since the locking slot 12 is slightly wider than the width of the bolt 7, it is easy to introduce the bolt 7 to the middle position A as shown in FIGS. 6 and 7.

After turning the hand lever 4 by means of the handle 4*b* upward by at least 10° into the position c, the engaging dog 7*c* of the bolt 7 enters so deeply into the wedge groove of the inner step 12*b* of the locking slot 12 that the engaging dog 7*c* grips behind the stop dog 12*c*. This provides the coupling between the hand lever 4 and the shaft 10 as shown in FIG. 7, position B. This lever position c is shown in FIG. 1. In order to be able to open the breechblock 3 the hand lever has to be turned by about 105° into the nearly vertical position (FIG. 1).

In general upon successive loading of a cartridge the ejectors are activated by the bottom of the cartridge. This releases the breechblock 3, i.e. the breech closing spring moves the breechblock again upwards which would entail simultaneous turning of the hand lever downwards.

It can be recognized from FIG. 1 that the hand lever 4 would suddenly pass through the space behind the gun and reserved for the gun operators and could cause personal injury to the persons operating the gun. In order to avoid this danger even in case when the gun operators by mistake neglect to remove the hand lever 4 from the shaft 10, the hand lever 4 after being released by the operators returns into the middle position A (FIG. 1 from f to e).

The hand lever based on its weight, its length and its center of gravity in connection with the construction of the bolt 7 and of the locking slot 11 provides for automatic disengagement of the hand lever 4 in the middle position and for its falling to the ground. This prevents any possibility of injuring the operators of the gun. The spring forces of the spring bolts 8 are practically not noticeable upon coupling the hand lever to the shaft. In addition to the above operating example, it can happen that the breech closing spring breaks during the operation of the gun. Again, in this situation the hand lever can be used reliably. When introduced the hand lever takes position e and is to be turned down to position a when the breechblock is completely closed. Both the hand lever and the spring bolt 8 operate also in opposite directions resulting in reliable disengagement of the hand lever 4 in the position b, which is the middle position A.

It thus will be seen that there is provided a device which achieves the various objects of the invention and which is well adapted to meet the conditions of practical use. As various changes might be made in the embodiment set forth above, it is to be understood that all matter herein described or shown in the accompanying drawings is to be interpreted as illustrative and not in a limiting sense.

I claim:

1. Hand lever system for operating the wedge-type breechblock of an artillery gun, comprising a shaft located at the bottom of the gun and connected with the breechblock;

a hand lever;

a device connecting the shaft and the hand lever, said drive including a socket at the end of said shaft having a two-step locking slot, each step of said two-step locking slot having prismatic surfaces converging toward the side of the shaft and said slot being open towards the outside at both ends of the slot;

a head at the free end of the hand lever having a two-step bolt with one step of the bolt and the locking slot providing a coupling between the hand lever and the shaft and the other step of bolt and locking slot having means for releasing the coupling;

said drive providing a coupling between shaft and hand lever upon actuation of the hand lever and automatically releasing the coupling between shaft and hand lever resulting in dropping of the hand lever upon non-actuation.

2. The hand lever system as set forth in claim 1, wherein the socket is at about the same level as the breech ring of the gun.

3. The hand lever system as set forth in claim 1, wherein the inner step of the locking slot is a root shaped groove with a stop dog increasing in height from the middle towards two outsides for engaging the correspoding engaging dog of the outer step of the bolt.

4. The hand lever system as set forth in claim 2, wherein the engaging dog of the outer step of the bolt is formed by roof shaped inclined planes converging in the middle and wherein the head of a pretensioned spring bolt protrudes from each of the two inclined planes which bolt heads exert pressure upon the inclined planes of the socket for placing the bolt in a middle position with regard to the slot of the socket.

5. The hand system as set forth in claim 4, wherein the width of the bolt is smaller than the clear width of the slot of the socket at the point of the locking position.

6. The hand lever system as set forth in claim 5, wherein the hand lever by means of its length, weight, center of gravity and by the distance and pretensioning of the spring bolts and of the socket automatically disengages the coupling between the shaft and the hand lever through the middle position.

* * * * *